US009700096B2

(12) United States Patent
McGinn et al.

(10) Patent No.: US 9,700,096 B2
(45) Date of Patent: Jul. 11, 2017

(54) MANDIBLE GUARD ATTACHMENT SYSTEM

(75) Inventors: Michael James McGinn, Montreal (CA); Stéphane Lebel, St. Redempteur (CA); Dominic Giroux Bernier, Montreal (CA)

(73) Assignee: Revision Military S.a.r.L., Luxembourg (LU)

( * ) Notice: Subject to any disclaimer, the term of this patent is extended or adjusted under 35 U.S.C. 154(b) by 1101 days.

(21) Appl. No.: 13/563,613

(22) Filed: Jul. 31, 2012

(65) Prior Publication Data

US 2014/0075654 A1 Mar. 20, 2014

(51) Int. Cl.
*A42B 3/18* (2006.01)
*A42B 3/32* (2006.01)

(52) U.S. Cl.
CPC ..... *A42B 3/18* (2013.01); *A42B 3/326* (2013.01)

(58) Field of Classification Search
CPC ..... A42B 3/18; A42B 3/326; A42B 3/205; A42B 3/20
USPC ..... 2/422, 424
See application file for complete search history.

(56) References Cited

U.S. PATENT DOCUMENTS 2,908,911 A * 10/1959 Sowle ..... A42B 3/08 2/424
3,216,023 A * 11/1965 Morgan ..... A42B 3/08 128/857
3,293,660 A * 12/1966 Macklin ..... A61F 9/024 2/9
3,897,598 A * 8/1975 Bednarczuk ..... A42B 3/20 2/9
4,042,974 A * 8/1977 Morgan ..... A42B 3/326 2/424
4,689,836 A * 9/1987 Vitaloni ..... A42B 3/326 2/411
4,766,615 A * 8/1988 Morin ..... A42B 3/326 2/410
4,769,857 A * 9/1988 Cianfanelli ..... A42B 3/326 2/421

(Continued)

FOREIGN PATENT DOCUMENTS

FR 2595920 A1 * 9/1987 ..... A42B 3/326
FR 2 876 882 A1 4/2006

(Continued)

OTHER PUBLICATIONS

International Search Report and Written Opinion for PCT/IB2014/003022 mailed Jun. 12, 2015.

*Primary Examiner* — Alissa L Hoey
(74) *Attorney, Agent, or Firm* — Wolf, Greenfield & Sacks, P.C.

(57) ABSTRACT

A contact surface, such as a seating surface on a mandible guard is adjustable such that variations in helmet geometry and/or mandible geometry can be accommodated. The mandible guard may be fixedly attached to a helmet with an attachment arm, yet be configured to permit adjustment of the height of the contact surface to reduce or eliminate a gap between the helmet and a guard portion of the mandible guard. A tilt arrangement may be provided between the attachment arm and the guard portion of the mandible guard to allow a wearer to adjust a pitch angle of the guard portion relative to the attachment arm.

12 Claims, 7 Drawing Sheets

(56) References Cited

U.S. PATENT DOCUMENTS 5,093,939 A * 3/1992 Noyerie ..... A42B 3/326 2/424
5,129,108 A * 7/1992 Copeland ..... A42B 3/20 2/424
5,146,245 A * 9/1992 Bolinger ..... G02C 5/20 351/118
5,263,204 A * 11/1993 Butsch ..... A42B 3/326 2/424
5,384,914 A * 1/1995 Caveness ..... A42B 3/20 2/424
5,412,814 A * 5/1995 Pernicka ..... A42B 3/20 2/424
5,483,699 A * 1/1996 Pernicka ..... A42B 3/08 2/424
6,125,477 A * 10/2000 Crippa ..... A42B 3/222 2/10
6,226,803 B1 * 5/2001 Tanaka ..... A42B 3/326 2/424
6,237,161 B1 * 5/2001 Lee ..... A42B 3/326 2/414
6,247,811 B1 * 6/2001 Rhoades ..... A61F 9/026 2/431
6,834,398 B1 * 12/2004 Martinez ..... A42B 3/326 2/424
7,900,268 B2 * 3/2011 Mahan ..... A42B 3/20 2/10
2002/0129440 A1 * 9/2002 Hong ..... A42B 3/326 2/422
2003/0182716 A1 * 10/2003 Wu ..... A42B 3/326 2/424
2006/0064799 A1 * 3/2006 Dion ..... A42B 3/326 2/424
2007/0083967 A1 * 4/2007 Crossman ..... A42B 3/044 2/15
2008/0289085 A1 * 11/2008 Bryant ..... A42B 3/328 2/421
2010/0132095 A1 * 6/2010 Gafforio ..... A42B 3/326 2/421
2011/0113519 A1 5/2011 Gendron et al.
2011/0113535 A1 5/2011 Lebel et al.
2011/0314594 A1 * 12/2011 Rogers ..... A42B 3/04 2/421
2012/0117717 A1 5/2012 McGinn et al.
2012/0222199 A1 * 9/2012 Tatomir ..... A42B 3/20 2/422
2014/0033406 A1 * 2/2014 Lebel ..... A42B 3/04 2/422
2015/0026858 A1 * 1/2015 Ross ..... A42B 3/18 2/2.5
2015/0033457 A1 * 2/2015 Tryner ..... A42B 3/08 2/421
2015/0135417 A1 * 5/2015 Lebel ..... A42B 3/326 2/424

FOREIGN PATENT DOCUMENTS

FR 2876005 A1 * 4/2006 ..... A42B 3/326
WO WO 2014/020441 A2 2/2014

* cited by examiner

MANDIBLE GUARD ATTACHMENT SYSTEM

FEDERALLY SPONSORED RESEARCH

This invention was made with government support under W911QY-11-C-0042 awarded by the Department of Defense. The government has certain rights in the invention.

FIELD OF THE INVENTION

The present invention relates generally to mandible systems for helmets, and more specifically to systems and methods of adjusting the seating of a mandible guard against a helmet.

DISCUSSION OF THE RELATED ART

A soldier, first responder, or law enforcement officer may wear protective headgear such as a helmet. Such a helmet may mount various accessories to aid and/or protect the helmet wearer for a specific activity or environment. For example, a mandible guard may be mounted to a helmet to provide jaw and face protection.

SUMMARY

According to one embodiment, a mandible guard for a helmet includes a guard portion and an attachment device adapted to attach the guard portion to the helmet. The attachment device including an attachment portion and an attachment arm, the attachment portion including at least two attachment points which are configured to attach to the helmet such that in an attached position, the attachment device does not pivot. The mandible guard also includes a first contact surface adapted to contact a second contact surface of the helmet when the mandible guard is attached to the helmet. The first contact surface is selectively adjustable relative to at least one of the guard portion and the attachment portion between a first adjustment position where the first contact surface is spaced a first distance from the attachment portion or the guard portion and a second adjustment position where the first contact surface is spaced a second, different distance from the attachment portion or guard portion.

According to another embodiment, a method of adjusting a position of a mandible guard relative to a helmet includes fixedly attaching a mandible guard to a helmet with an attachment device that includes an attachment portion such that the attachment portion does not pivot relative to the helmet. The method also includes adjusting the position of a first contact surface of the mandible guard from a first adjustment position to a second adjustment position, the first contact surface being adapted to contact a second contact surface of the helmet, wherein in the first adjustment position the first contact surface is spaced a first distance from the attachment portion or the guard portion, and in the second adjustment position the first contact surface is spaced a second, different distance from the attachment portion or the guard portion.

According to a further embodiment, a helmet includes a mounting portion on the helmet to mount a mandible guard to the helmet, the mounting portion having at least two mounting points which are configured to receive an attachment device of the mandible guard such that in an attached position, the attachment device does not pivot relative to the helmet. The helmet has a contact surface adapted to contact a corresponding contact surface on the mandible guard when the mandible guard is mounted to the helmet. The contact surface is selectively adjustable relative to the helmet between a first adjustment position where the contact surface is spaced a first distance from the helmet and a second adjustment position where the contact surface is spaced a second, different distance from the helmet.

According to another embodiment, a mandible guard for a helmet includes a guard portion and an attachment device adapted to attach the guard portion to the helmet, the attachment device including an attachment portion and an attachment arm. The mandible guard also includes a first contact surface adapted to contact a second contact surface of the helmet when the mandible guard is attached to the helmet. The first contact surface is selectively adjustable relative to at least one of the guard portion and the attachment portion between a first adjustment position where the first contact surface is spaced a first distance from the attachment portion or the guard portion and a second adjustment position where the first contact surface is spaced a second, different distance from the attachment portion or guard portion. The guard portion is pivotably connected to the attachment arm.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
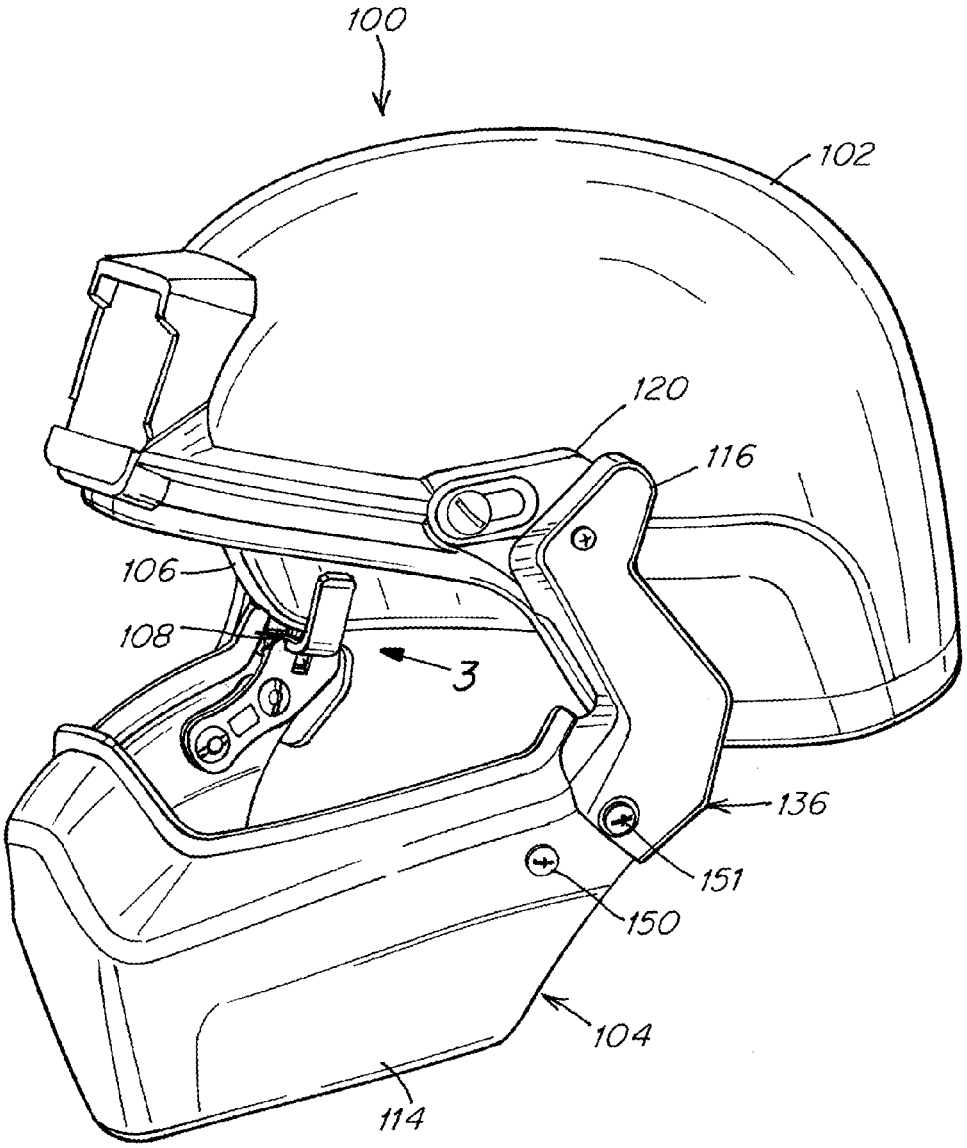
FIG. 1 is a perspective view of a helmet assembly outfitted with a mandible guard.

A mandible guard may be permanently or removably mounted to a helmet to provide jaw and face protection from projectiles, impacts or other dangers. When the mandible guard is subjected to an impact force, the force is transferred to the helmet via the physical interface of the mandible guard and the helmet. In some helmet systems with attached mandible guards, a seat is provided on the mandible guard to cradle the helmet rim. This arrangement provides a surface-to-surface force transfer that limits the amount of torque and/or concentrated stresses applied to other components of the helmet and/or mandible guard.

Applicants have recognized that if the mandible guard seat is not in close contact with the helmet rim, forces on the mandible guard may be undesirably transferred through the attachment points of the mandible guard to the helmet. For example, a mandible guard may have two attachment arms, one on each side of the helmet, and each attachment arm may be attached to the helmet at one or more attachment points. If the helmet rim is not properly seated in the mandible guard seat, an impact force on the mandible guard may apply a torque and/or force on the attachment points which could lead to component damage or failure.

Variability in manufacturing processes can lead to helmets which have different component sizes. For example, the distance between a helmet's mandible guard mounting location and the helmet's rim which seats against the mandible guard can vary from helmet to helmet. Such variation can lead to some helmets having a rim that does not reach the seating surface of the mandible guard when the mandible guard is mounted to the helmet, resulting in the potential for an inadequate transfer of impact force through the intended force transfer path.

In some cases a helmet's rim may extend too far downwardly such that when the mandible guard is attached to the helmet, contact is made prematurely between the helmet and mandible guard seating surface. This contact may prevent the mandible guard from being mountable to the helmet, or may result in an unintended pitch angle of the mandible guard relative to the helmet.

Mandible guards may have a pitch angle adjustment arrangement which allows a wearer to rotate the mandible guard up or down and secure the mandible guard at a preferred pitch angle. Decoupling of the pitch adjustment from the adjustment of the interface of the mandible guard seat and the helmet rim would permit a wearer to adjust one aspect of the mandible guard fit without requiring re-adjustment of the other aspect. Further, in coupled systems, certain combinations of the two adjustable aspects may not be possible.

According to embodiments disclosed herein, a contact surface (such as a seating surface) on a mandible guard is adjustable such that variations in helmet geometry and/or mandible guard geometry can be accommodated. The adjustment may be an adjustment of the distance from the contact surface to the attachment points where the mandible guard is configured to attach to the helmet. In some embodiments, an adjustment member is provided on the mandible guard to adjust the height of the contact surface on the mandible guard, and part of the adjustment member may form the contact surface. In this manner, when assembled, the rim of the helmet can be suitably seated against the mandible guard. The particular arrangement and adjustability of the adjustment member may allow the assembler or wearer to make adjustments that do not change the pitch angle of the mandible guard.

In some embodiments, an adjustment member is provided on the helmet such that a distance can be adjusted between a contact surface on the helmet, such as a rim, and a mounting location where the helmet mounts a mandible guard. These embodiments and others are described in further detail below with reference to the accompanying figures.

FIG. 1 illustrates an embodiment of a helmet assembly 100 including one embodiment of a mandible guard adjustment system. The helmet assembly includes a helmet 102, such as a military helmet, and a mandible guard 104 connected to the helmet 102. In some embodiments, a protective face shield (not shown), such as a transparent visor or transparent face shield, is connected to the helmet substantially between a front of helmet 102 and the mandible guard 104.

Helmet 102 includes a rim 106, which at certain locations, abuts mandible guard 104. For example, a rim 106 is shown in contact with seat 108 in FIG. 1.

Figure 2:
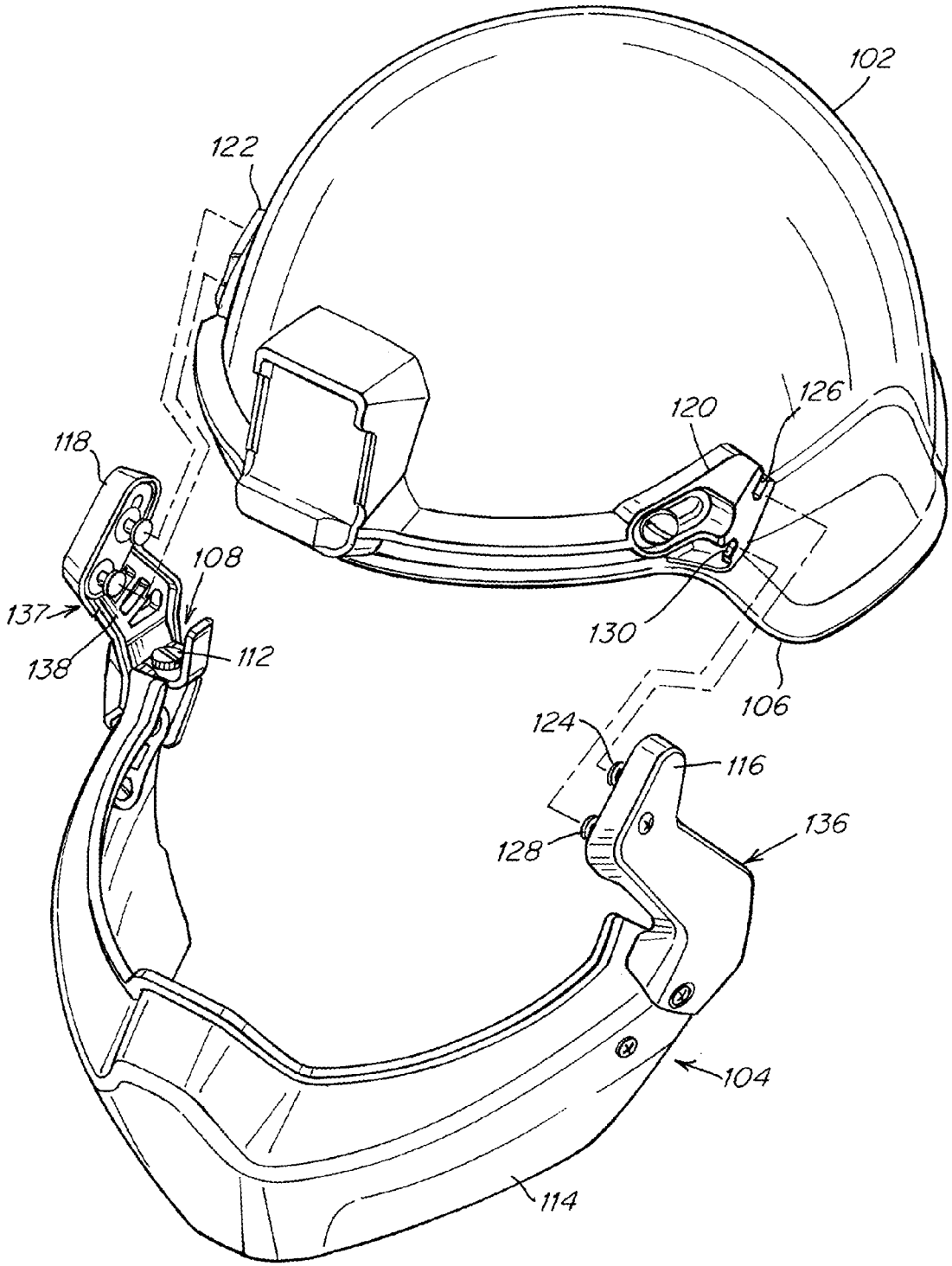
FIG. 2 is a perspective view of the helmet assembly of FIG. 1 with the mandible guard removed.

FIG. 2 show mandible guard 104 removed from helmet 102. Seat 108 is provided on mandible guard 104 to contact rim 106 of helmet 102. As discussed above, contact between seat 108 and rim 106 provides a path for forces on the mandible guard to be transferred to helmet 102. An adjustment member, such as an adjustment screw 112, is provided on the mandible guard in the illustrated embodiment, as described further below with reference to FIGS. 3-6.

The illustrated embodiment of an arrangement for attaching the mandible guard to the helmet is described here briefly, and a more complete description may be found in the application entitled, "Helmet Accessory Attachment System", filed on even date herewith, which is incorporated by reference herein in its entirety. Of course other embodiments of a mandible guard attachment arrangement may be used in conjunction with the mandible guard adjustment embodiments disclosed herein.

Mandible guard 104 includes a guard portion 114 and two attachment devices 136, 137. Each attachment device includes an attachment portion (e.g., attachment portions 116, 118) and an attachment arm (e.g., attachment arm 138 shown in FIGS. 2 and 3, and attachment arm 140 shown in FIG. 4). Helmet 102 includes two mounting portions 120, 122. To connect attachment portion 116 to mounting portion 120 such that mandible guard 104 becomes mounted to helmet 102, a user positions a slide member 124 of the attachment portion in a first corresponding channel 126 on mounting portion 120. The slide member then is selectively moved toward a release position while positioned in the first corresponding channel. The attachment portion is subsequently pivoted relative to the mounting portion until a position member 128 is aligned with a second corresponding channel 130 on the mounting portion. In some embodiments, this pivoting of the attachment portion comprises a pivoting around the slide member. Once aligned, the user releases the attachment portion. Due to the biasing element, the slide member is urged toward a home position closer to the position member, thus drawing the position member into the second channel and securing the attachment portion to the mounting portion in a fixed connection when in the attached position. In this position, the attachment device is not pivotable relative to the helmet due to the two attachment points. To remove the attachment portion from the mounting portion, the user pulls the position member out of the second channel, pivots the attachment portion such that the position member is not aligned with the second channel, and then removes the slide member from the first channel. When two attachment portions and two corresponding mounting portions are provided, as illustrated, the same actions described above may simultaneously performed with attachment portion 118 and mounting portion 122. In some embodiments, this system permits a user to attach and remove the accessory attachment portion from the mounting portion using a single hand.

Figure 3:
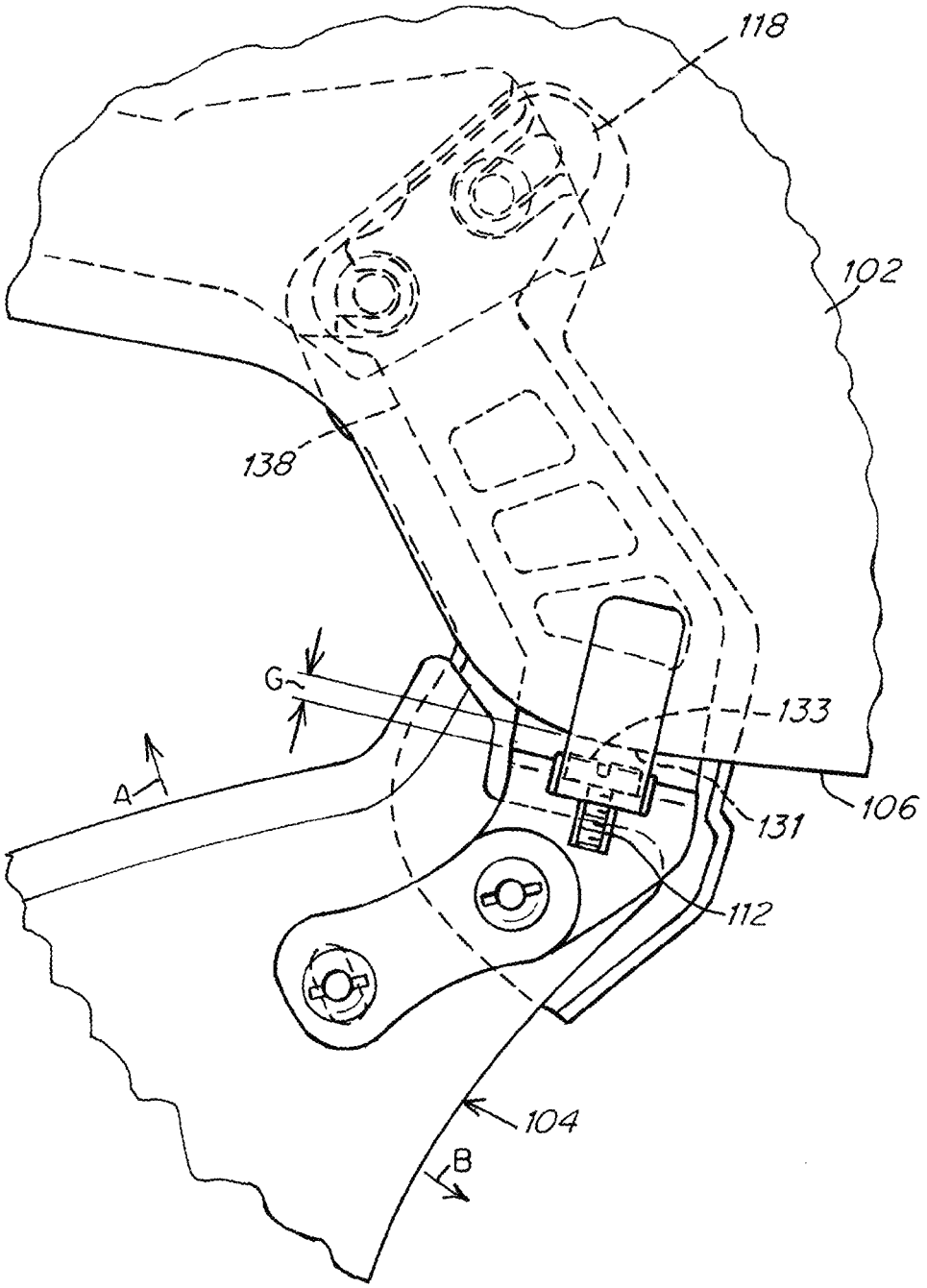
FIG. 3 is a side view of a seating adjustment arrangement according to one embodiment.

FIG. 3 shows one side of mandible guard 104 attached to helmet 102 with the attachment arrangement illustrated in FIG. 2. The view illustrated in FIG. 3 is from the inside of the helmet with exterior components shown in phantom.

A second contact surface 131 on the helmet is provided by rim 106, and a first contact surface 133 on the mandible guard is provided by a head 134 of adjustment screw 112. An attachment arm 138 positions contact surface 133 at a first distance from attachment portion 116. Preferably, this first distance is approximately the same as the distance from attachment position 116 to contact surface 131 of the helmet so that the two contact surfaces suitably contact one another when the mandible guard is mounted to the helmet. Attachment arm 138 and helmet 102 can be designed and manufactured with the intent of the distances being virtually equal, however, due to manufacturing variability, these distances may not be equal, and a gap G between the two contact surfaces may result.

Figure 4:
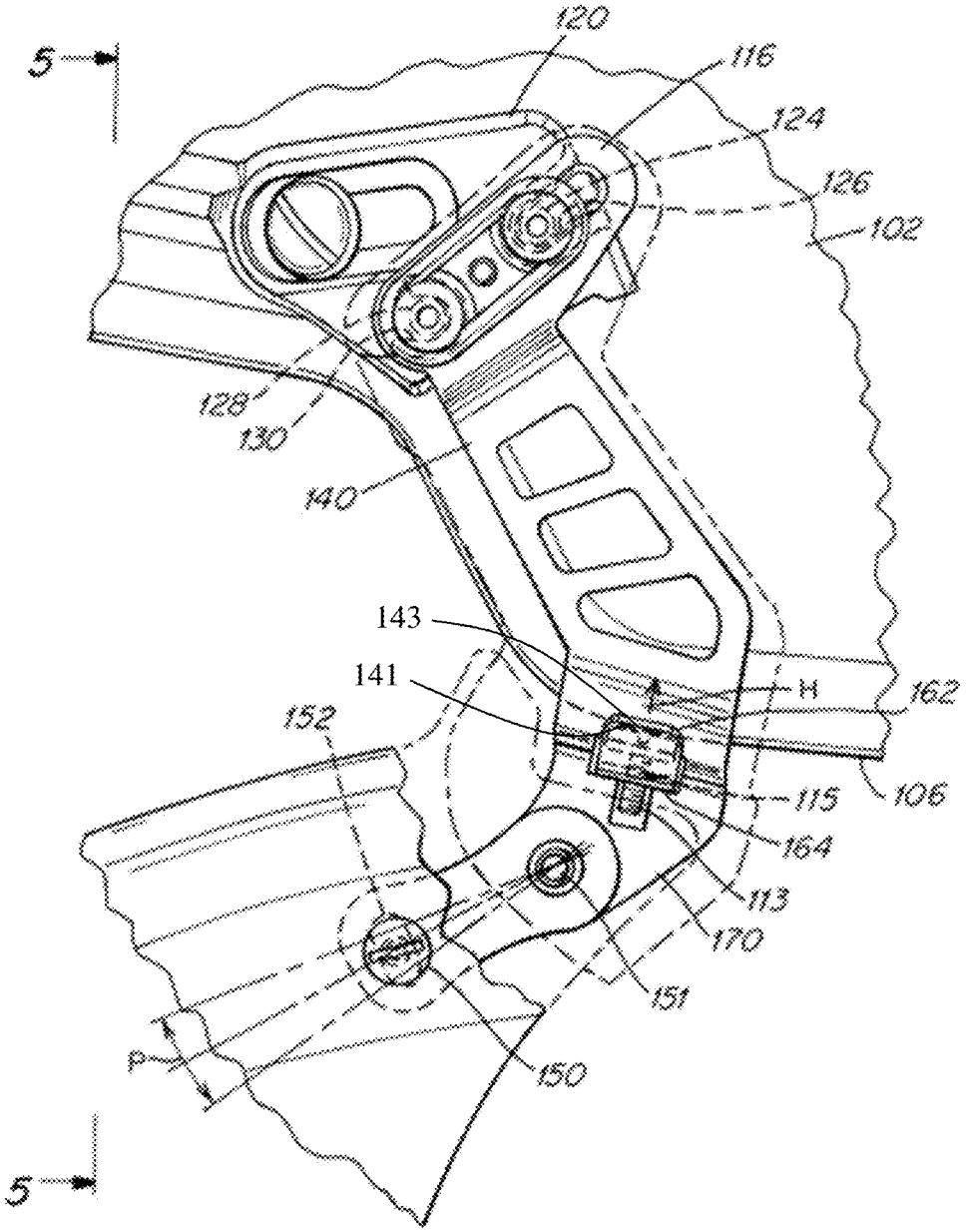
FIG. 4 is a side view of one embodiment providing seating adjustment and pivoting adjustment of a mandible guard.

A pitch angle of guard portion 114 may be adjusted by pivoting guard portion 114 up or down in directions A and B in FIG. 3. In FIG. 4, which shows the opposite side of helmet 102 from an outside viewpoint, a range of guard portion 114 pitch angle adjustment P is shown. Pitch angle P may be adjusted by loosening a first bolt 150 such that first bolt 150 can be moved through a slot 152 in a lower brace portion 170 of an attachment arm 140 to pivot around a second bolt 151. A more detailed description of this arrangement is provided below with reference to FIG. 7. Similar to the first and second contact surfaces depicted in FIG. 3, the side of the helmet depicted in FIG. 4 includes a third contact surface 143 on the mandible guard and a fourth contact surface 141 on the helmet.

To reduce or preferably eliminate gap G from between the contact surface of the mandible guard and the contact surface of the helmet, mandible guard 114 can be adjusted from a first adjustment configuration to a second adjustment configuration. For example, as shown in FIG. 4, an adjustment member such as and adjustment screw 112 can be raised in direction H to eliminate the gap between the two contacts surfaces. In some embodiments, mandible guard 114 is removed from helmet 102 to gain access to adjustment screw 112 for rotation of the screw. Once adjusted, the mandible guard is reattached to the helmet, and the presence of a gap is reevaluated. If no gap remains, and the adjustment screw is not so high as to adversely affect the attachment of the mandible guard to the helmet, further adjustment is not necessary. If, however, a gap remains, the user may remove the mandible guard and once again change the height of adjustment screw 112.

Adjustment screw may be received and rotated within a threaded hole 115 in a horizontal portion 164 of seat 108. Adjustment screw 112 may have a textured head to allow rotation by a user's fingers such that the adjustment can be made tool-free. A screwdriver slot, a hex key slot, or other suitable features also may be included to permit use of a tool to rotate the adjustment screw.

By using an adjustment screw as an adjustment member, the height of the mandible guard contact surface can be continuously adjusted throughout a range of adjustment positions. For example, in the embodiment shown in FIG. 4, the change in position of adjustment screw 112 has a vertical component, and the vertical position can be finely adjusted. In other embodiments, an adjustment member may be provided which only allows a limited number of adjustment configurations. For example, a metal plate may be provided as a contact surface, and the metal plate may be adjustable to a discrete number of vertical positions. The plate may be attached to a slide pin that is movable along a vertical slot with periodic horizontal slots into which the slide pin can be positioned.

Adjustment of the mandible guard contact surface from a non-contact configuration to a contact configuration is achieved in manner by which the pitch angle of the mandible guard portion 114 is not affected. Similarly, adjustments to the mandible guard portion pitch angle do not affect the contact surface adjustment configurations. Accordingly, if a user adjusts one aspect of the mandible guard (e.g., the contact surface height), a further adjustment to another aspect (e.g., pitch angle) is not necessarily required. Further, in coupled systems, the dependency of one aspect on the other may limit the range of adjustments available.

Figure 5:
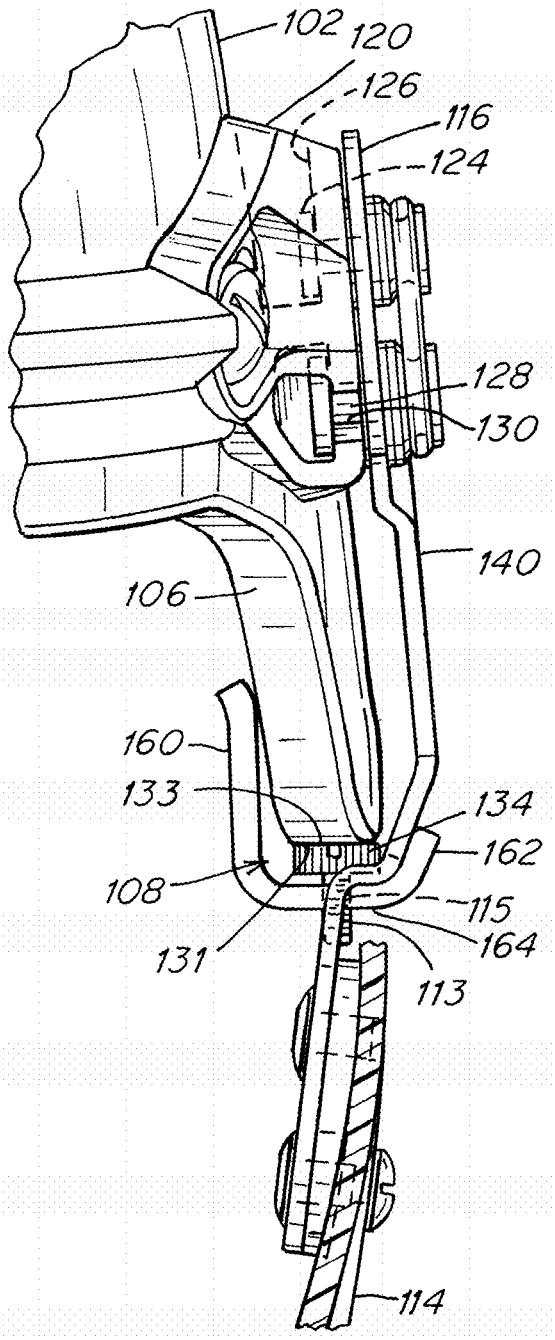
FIG. 5 is a front view of the attachment and adjustment system shown in FIG. 5.

FIG. 5 shows a contact surface 131 on the helmet directly abutting a contact surface 133 on the mandible guard after adjustment of an adjustment screw 113. An interior arm 160 and/or and exterior arm 162 may be included on mandible guard 104 to aid with lateral stability of mandible guard 104 on helmet 102.

Figure 6:
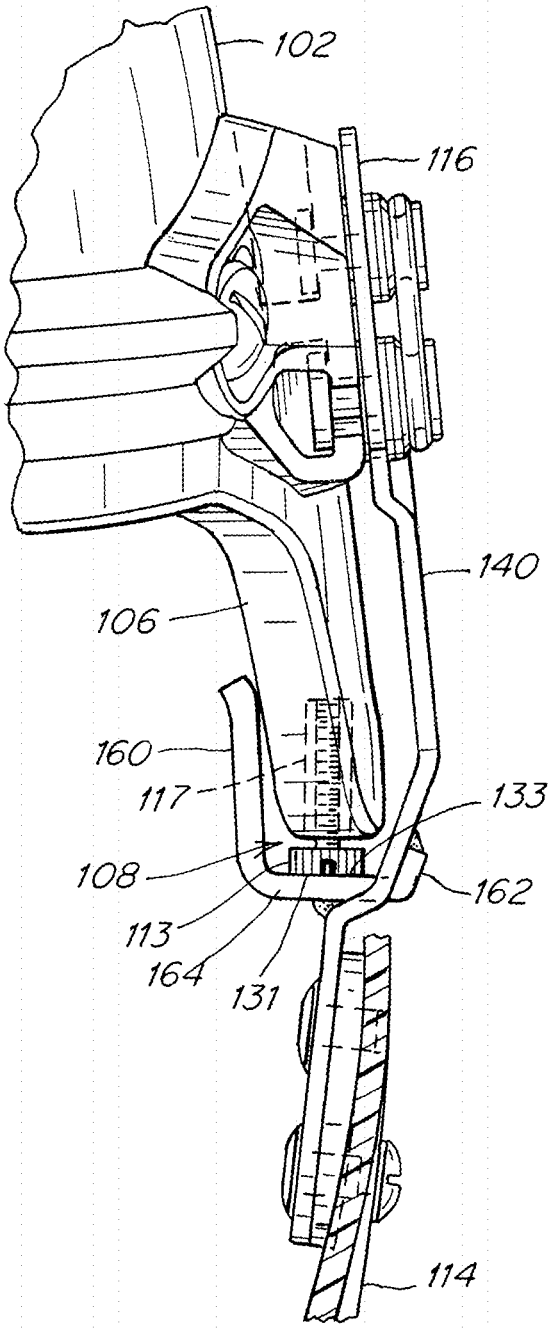
FIG. 6 is a front view of an alternative embodiment of a mandible guard adjustment system.

FIG. 6 shows an alternative embodiment where adjustment screw 113 is positioned on the helmet to adjust the distance from the attachment position of the mandible guard to the downwardly-facing contact surface of the helmet. In this embodiment, if a gap exists between the two contact surfaces, adjustment screw 113 can be extended further downwardly from rim 106 to reduce or eliminate the gap. In this embodiment, the contact surface 131 of the helmet is the head of adjustment screw 113, and the contact surface 133 of the mandible guard is horizontal portion 164 of seat 108. Adjustment screw 113 may be received and rotated within a threaded insert 117.

For purposes herein, a downwardly-facing contact surface includes surfaces which have a downward facing direction component when the helmet and mandible guard assembly is positioned in a typical orientation on an upright wearer. That is, a downwardly-facing surface is not required to be facing directly vertically downwardly, but may instead point at an angle relative to vertical. Similarly, for purposes herein, an upwardly-facing surface is not require to face directly vertically upwardly to be considered an upwardly-facing surface.

In another alternative embodiment, the adjustment configuration of mandible 104 is adjustable by changing the length of attachment arms 138, 140. For example, each attachment arm may be divided into two sections which are slidable relative to one another to reduce or extend the overall length of the attachment arm.

Figure 7:
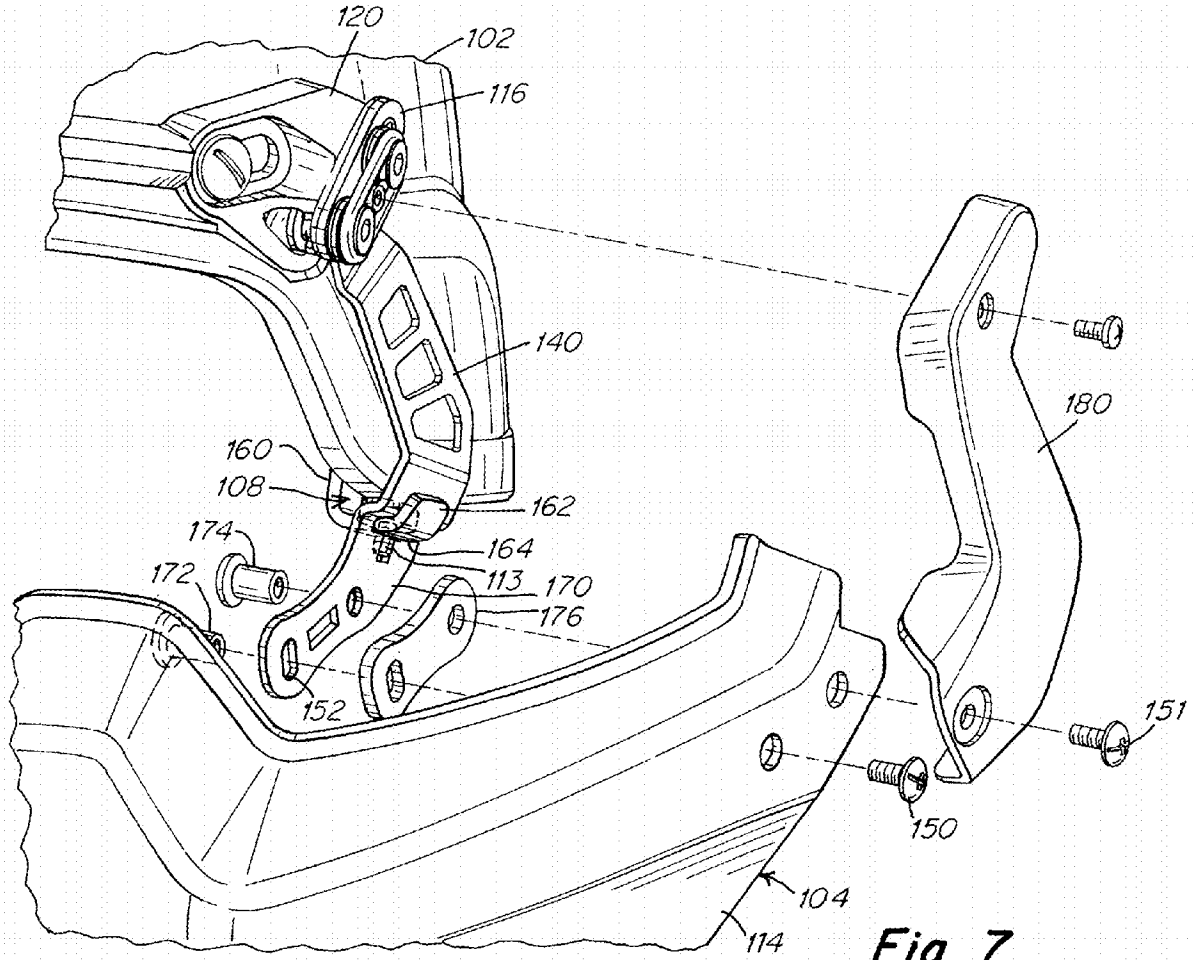
FIG. 7 is an exploded perspective view of various components associated with adjustment of the mandible guard.

FIG. 7 shows a partially exploded view of the attachment and adjustment assembly disclosed herein. A cover plate 180 is provided to cover and protect various components of the attachment and adjustment system. Attachment arm 140 includes lower brace portion 170 which has slot 152. Bolt 150 engages with a threaded boss 172, and when bolt 150 is loosened, the bolt and boss can slide within slot 152, thereby adjusting the pitch angle of the mandible guard relative to the helmet. This pivoting occurs around an axis through bolt 151 and its corresponding threaded boss 174. A shim 176 may be provided between mandible guard portion 114 and lower brace portion 170. Bolts 150, 151 are tightened within their corresponding bosses 172, 174 to secure guard portion 114 to lower brace portion 170.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A mandible guard for a helmet, comprising:

a guard portion configured to extend from a first side of the helmet to a second, opposite side of the helmet when the mandible guard is attached to the helmet, the guard portion positioned to provide protection to a user's face;

a first attachment device adapted to attach the guard portion to the first side of helmet, the first attachment device including a first attachment portion and a first attachment arm;

a second attachment device adapted to attach the guard portion to the second side of the helmet, the second attachment device including a second attachment portion and a second attachment arm;

a first contact surface associated with the first attachment device and adapted to contact a second contact surface of the first side of the helmet when the mandible guard is attached to the helmet;

a third contact surface associated with the second attachment device and adapted to contact a fourth contact surface of the second side of the helmet when the mandible guard is attached to the helmet;

a first pivotal connection to pivotally connect a first side of the guard portion to the first attachment arm; and a second pivotal connection to pivotally connect a second side of the guard portion to the second attachment arm; wherein the first contact surface is selectively adjustable relative to the guard portion between a first adjustment position where the first contact surface is spaced a first distance from the guard portion and a second adjustment position where the first contact surface is spaced a second, different distance from the guard portion, wherein the first contact surface is held in the first adjustment position by the first attachment device when the first contact surface is adjusted to the first adjustment position, and the first contact surface is held in the second adjustment position by the first attachment device when the first contact surface is adjusted to the second adjustment position;

the third contact surface is selectively adjustable relative to the guard portion between a third adjustment position where the third contact surface is spaced a third distance from the guard portion and a fourth adjustment position where the third contact surface is spaced a fourth distance, different from the third distance, from the guard portion, wherein the third contact surface is held in the third adjustment position by the second attachment device when the third contact surface is adjusted to the third adjustment position, and the third contact surface is held in the fourth adjustment position by the second attachment device when the third contact surface is adjusted to the fourth adjustment position; and the guard portion is pivotable relative to the first and second attachment arms via the first and second pivotal connections to adjust a pitch angle of the guard portion relative to the first and second attachment arms.

2. The mandible guard as in claim 1, wherein the first attachment portion includes at least two attachment points which are configured to attach to the helmet such that in an attached position, the first attachment device does not pivot relative to the helmet.

3. The mandible guard as in claim 2, wherein the mandible guard includes a first adjustment member, the first adjustment position of the first contact surface includes the first adjustment member in a first position, and the second adjustment position of the first contact surface includes the first adjustment member in a second position, different from the first position.

4. The mandible guard as in claim 3, further comprising a helmet.

5. The apparatus as in claim 3, wherein the first adjustment member is movable up and down relative to the mandible guard.

6. The apparatus as in claim 5, wherein the first contact surface comprises an upwardly-facing surface on the first adjustment member.

7. The apparatus as in claim 6, wherein the first contact surface is configured to contact a downwardly-facing contact surface of a rim of the helmet when the mandible guard is attached to the helmet.

8. The apparatus as in claim 6, wherein the first adjustment member comprises a threaded screw that is movable up and down via rotation of the screw.

9. The apparatus as in claim 5, wherein the first adjustment member is continuously adjustable along a range of vertical positions.

10. The apparatus as in claim 1, wherein adjustments to the pitch angle with the first and second pivotal connections do not affect the distance of the first contact surface from the second contact surface when the mandible guard is attached to the helmet.

11. The apparatus as in claim 1, wherein when the first contact surface is in the first adjustment position, the first contact surface is out of contact with the second contact surface of the helmet, and when the first contact surface is in the second adjustment position, the first contact portion is in contact with the second contact surface of the helmet.

12. The apparatus as in claim 1, wherein the second contact surface is a rim of the helmet.

* * * * *